US007791628B2

(12) United States Patent
Miyadera

(10) Patent No.: US 7,791,628 B2
(45) Date of Patent: Sep. 7, 2010

(54) DEVIATION AMOUNT DETECTING DEVICE, DEVIATION AMOUNT DETECTING METHOD, AND COMPUTER-READABLE RECORDING MEDIUM

(75) Inventor: Tatsuya Miyadera, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/353,278

(22) Filed: Jan. 14, 2009

(65) Prior Publication Data

US 2009/0185816 A1 Jul. 23, 2009

(30) Foreign Application Priority Data

Jan. 18, 2008 (JP) ..... 2008-009515
Jan. 8, 2009 (JP) ..... 2009-002699

(51) Int. Cl.
*B41J 2/435* (2006.01)
*B41J 2/47* (2006.01)

(52) U.S. Cl. ..... 347/234; 347/248

(58) Field of Classification Search ..... 347/116, 347/229, 232, 234, 235, 248–250; 399/301
See application file for complete search history.

(56) References Cited

U.S. PATENT DOCUMENTS 5,844,591 A * 12/1998 Takamatsu et al. ..... 347/235
7,224,378 B2 * 5/2007 Maeda ..... 347/235
7,589,846 B2 * 9/2009 Yoshida ..... 358/1.13
2004/0100550 A1 * 5/2004 Bannai et al. ..... 347/232
2008/0038024 A1 2/2008 Miyadera
2008/0069602 A1 3/2008 Miyadera
2008/0170868 A1 7/2008 Miyadera
2008/0212986 A1 9/2008 Miyadera

FOREIGN PATENT DOCUMENTS

JP 2005-156992 6/2005

* cited by examiner

*Primary Examiner*—Hai C Pham
(74) *Attorney, Agent, or Firm*—IPUSA, PLLC

(57) ABSTRACT

A deviation amount detecting device for use in an electrophotographic color image forming device is configured to correct, during an inter-cycle period in which computation of a first deviation amount using a result of reading of deviation detection patterns is held in a waiting state, a second deviation amount computed using a result of measurement of a scanning time of a light beam, based on a first deviation amount computed at a latest cycle, so that a corrected amount of deviation of a main scanning direction and a corrected amount of deviation of a sub-scanning direction are computed.

10 Claims, 10 Drawing Sheets

DEVIATION AMOUNT DETECTING DEVICE, DEVIATION AMOUNT DETECTING METHOD, AND COMPUTER-READABLE RECORDING MEDIUM

BACKGROUND OF THE INVENTION

1. Field of the Invention

This invention relates to a deviation amount detecting device which computes an amount of deviation for each of multiple toner images of different colors in a color image forming device wherein a color image is formed by superimposing the toner images of different colors.

2. Description of the Related Art

In a tandem type color image forming device, a color image is formed on a recording sheet or an intermediate transfer belt by using four image formation units of different colors which are arranged to superimpose the toner images on one another on the recording sheet or the intermediate transfer belt.

In the image forming device of this type, if the position where the toner images of the respective colors are superimposed slightly deviates from a desired position, it is difficult to stably obtain a color image with good quality. To avoid this problem, deviation compensation patterns of the respective colors formed on a transporting member are detected, and the deviation compensation is performed so that the toner images of the respective colors are superimposed at the same position. Specifically, by this deviation compensation, each of the detection results of color patterns (cyan, magenta and yellow) is compared with the detection result of a reference color pattern (black), and an amount of deviation of each color pattern to the reference color pattern is computed. Refer to Japanese Laid-Open Patent Application No. 2005-156992.

However, even if the computation of the amount of deviation and the deviation compensation are performed, a deviation will take place again according to various factors with the passage of time. Especially, if the reflection characteristics of the reflection mirror of the image forming device change due to a temperature rise of the exposure unit of the image forming device, a deviation may easily take place.

Conventionally, in order to correct the deviation which takes place due to the temperature rise of the exposure unit, it is necessary to frequently-perform a deviation compensation process using the deviation compensation patterns.

However, the deviation compensation process using the deviation compensation patterns requires forming color patterns on the transporting member. For this reason, there is a problem that, during the deviation compensation process, the image formation process cannot be performed by the image forming device. In addition, the deviation compensation process using the deviation compensation patterns requires a series of several tasks, including the formation of color patterns on the transporting member, the reading of the color patterns by the sensors and the computation based on the pattern reading results, and much time is needed to complete the deviation compensation process.

SUMMARY OF THE INVENTION

In one aspect of the invention, the present disclosure provides an improved deviation amount detecting device and method in which the above-described problems are eliminated.

In one aspect of the invention, the present disclosure provides a deviation amount detecting device and method which is able to compute the amount of deviation quickly even when the image forming device is performing an image formation process.

In an embodiment of the invention which solves or reduces one or more of the above-mentioned problems, the present disclosure provides a deviation amount detecting device which computes an amount of deviation for each of the toner images of different colors in an electrophotographic color image forming device wherein a color image is formed on a transporting member by superimposing the toner images of different colors, the deviation amount detecting device including: a first computing unit configured to compute a first deviation amount repeatedly at cycles of a predetermined time based on a result of reading of deviation detection patterns formed on the transporting member of the image forming device; a second computing unit configured to compute a second deviation amount based on a result of measurement of a scanning time between a start and an end of one main scan of a light beam on an image support of the image forming device; and a third computing unit configured to correct, during an inter-cycle period in which the computation of the first deviation amount by the first computing unit is held in a waiting state, the second deviation amount computed by the second computing unit, based on the first deviation amount computed by the first computing unit at a latest cycle, so that a corrected amount of deviation of a main scanning direction and a corrected amount of deviation of a sub-scanning direction are computed.

DETAILED DESCRIPTION OF THE PREFERRED EMBODIMENTS

Figure 1:
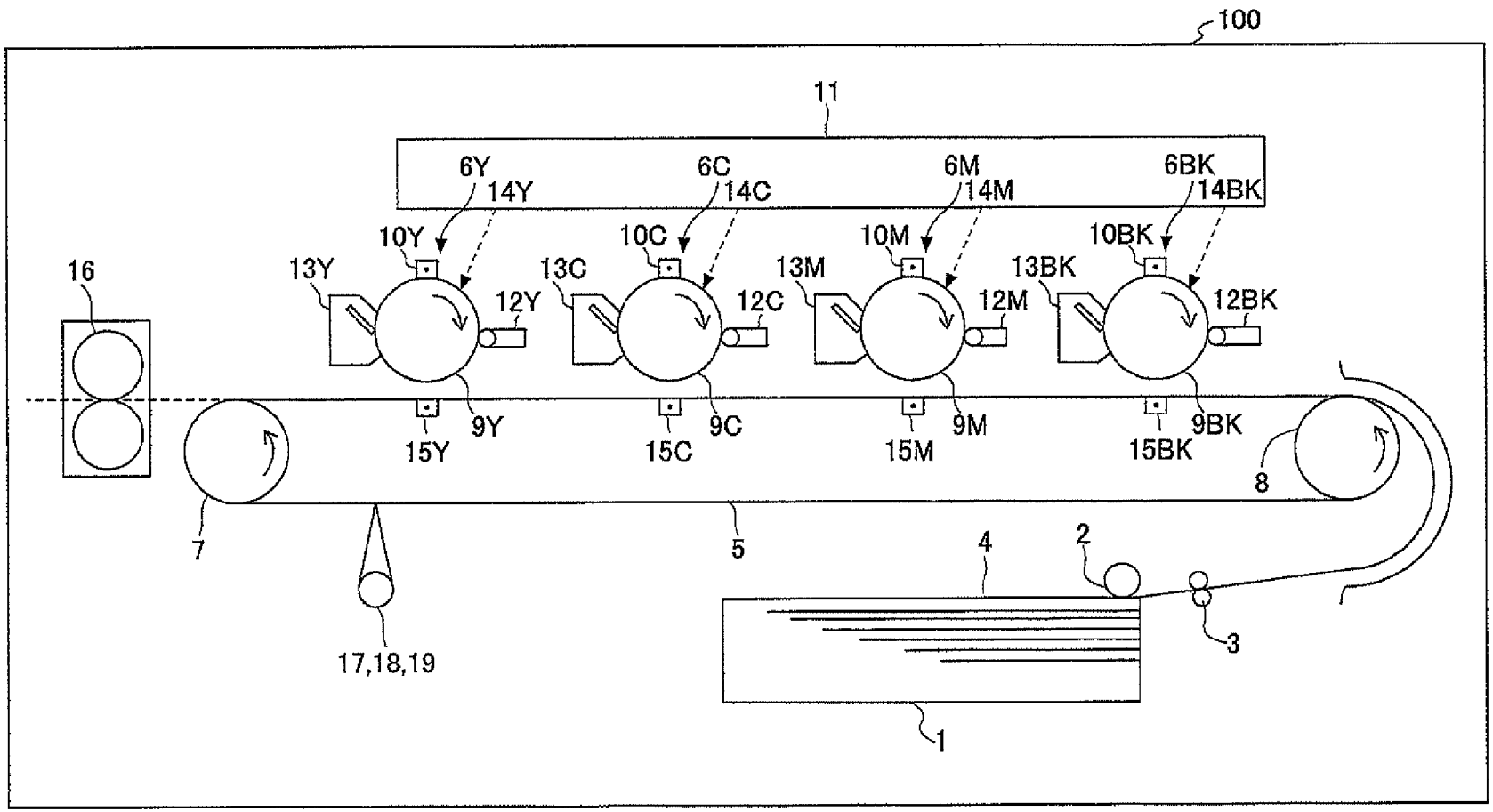
FIG. 1 is a diagram showing the composition of an image forming device including a deviation amount detecting device of an embodiment of the invention.

A deviation amount detecting device of an embodiment of the invention includes: a first computing unit which computes a first deviation amount repeatedly at cycles of a predetermined time based on a result of reading of deviation detection patterns formed on a transporting member of an electrophotographic color image forming device; a second computing unit which computes a second deviation amount based on a result of measurement of a scanning time between a start and an end of one main scan of a light beam on an image support of the image forming device; and a third computing unit which corrects, during an inter-cycle period in which the computation of the first deviation amount by the first computing unit is held in a waiting state, the second deviation amount computed by the second computing unit, based on the first deviation amount computed by the first computing unit at a latest cycle, so that a corrected amount of deviation of a main scanning direction and a corrected amount of deviation of a sub-scanning direction are computed.

The above-mentioned deviation amount detecting device may be arranged to further include a measuring unit which measures a scanning time between a time the light beam is read by a first sensor disposed to be perpendicular to the main scanning direction at a position outside an imaging region corresponding to the start of one main scan and a time the light beam is read by a second sensor disposed to have a predetermined inclination angle to the main scanning direction at a position outside the imaging region corresponding to the end of one main scan.

The above-mentioned deviation amount detecting device may be arranged so that the second computing unit is configured to compute an amount of change of the scanning time after the scanning time is measured multiple times, so that the second deviation amount is computed based on the amount of change of the scanning time.

The above-mentioned deviation amount detecting device may be arranged so that the first computing unit is configured to compute a main deviation amount of the main scanning direction and a sub-deviation amount of the sub-scanning direction respectively based on the result of reading of the deviation detection patterns, and the third computing unit is configured to compute a corrected amount of deviation of the main scanning direction and a corrected amount of deviation of the sub-scanning direction respectively by using both a ratio of the sub-deviation amount computed by the first computing unit to a sum of the main deviation amount and the sub-deviation amount both computed by the first computing unit, and a ratio of the second deviation amount computed by the second computing unit to the sum of the main deviation amount and the sub-deviation amount both computed by the first computing unit.

The above-mentioned deviation amount detecting device may be arranged so that the predetermined inclination angle to the main scanning direction is equal to $\pi/4$ (45°).

A deviation amount detecting method of an embodiment of the invention includes: computing a first deviation amount repeatedly at cycles of a predetermined time based on a result of reading of deviation detection patterns formed on a transporting member of an electrophotographic color image forming device; computing a second deviation amount based on a result of measurement of a scanning time between a start and an end of one main scan of a light beam on an image support of the image forming device; and correcting, during an inter-cycle period in which the computation of the first deviation amount is held in a waiting state, the computed second deviation amount based on the first deviation amount computed at a latest cycle, so that a corrected amount of deviation of a main scanning direction and a corrected amount of deviation of a sub-scanning direction are computed.

A computer-readable recording medium of an embodiment of the invention may be arranged to store a deviation amount detecting program which, when executed by a computer, causes the computer to perform the above-mentioned deviation amount detecting method.

According to the embodiments of the invention, it is possible to provide a deviation amount detecting device and method which can compute the amount of deviation quickly even when the image forming device is performing an image formation process.

Other objects, features and advantages of the invention will be more apparent from the following detailed description when read in conjunction with the accompanying drawings.

A description will be given of embodiments of the invention with reference to the accompanying drawings.

The composition of a color image forming device including a deviation amount detecting device of an embodiment of the invention will be described with reference to FIG. 1. FIG. 1 is a diagram showing the composition of a color image forming device including a deviation amount detecting device 100 of an embodiment of the invention.

The color image forming device shown in FIG. 1 is a tandem type electrophotographic image forming device. The deviation amount detecting device 100 is arranged for correcting an amount of deviation for each of multiple toner images of different colors formed by the tandem type electrophotographic image forming device. The deviation amount detecting device 100 uses an image formation unit that is the same as the image formation unit of the color image forming device. The composition and operation of the image formation unit of the color image forming device in this embodiment will be described.

As shown in FIG. 1, the color image forming device in this embodiment includes a paper tray 1, a feed roller 2, a separation roller 3, a recording sheet 4, a belt member (also called a transporting belt) 5, image formation units 6BK, 6M, 6C, 6Y, a driving roller 7, a driven roller 8, photoconductor drums 9BK, 9M, 9C, 9Y, charging units 10BK, 10CM, 10C, 10Y, an exposure unit 11, developing units 12BK, 12M, 12C, 12Y, charge eliminating units 13BK, 13M, 13C, 13Y, transferring units 158K, 15M, 15C, 15Y, a fixing unit 16, and sensors 17, 18, 19. Laser beams 14BK, and 14M, 14C and 14Y are the exposure beams of each image color.

As shown in FIG. 1, in the color image forming device in this embodiment, the image formation unit 6BK to form an image of black as a reference color and the image formation units 6M, 6C and 6Y to form images of other colors, which are magenta, cyan and yellow, are arranged in order along the endless-type transporting belt 5. Namely, the image formation units 6BK, 6M, 6C and 6Y are arranged along the transporting belt 5 (which transports a recording sheet 4 supplied from the paper tray 1 by the feed roller 2 and the separation roller 3) sequentially from the upstream side of the transporting belt 5 in the transporting direction.

The image formation units 6BK, 6M, 6C and 6Y are arranged to form toner images of different colors (black, magenta, cyan, yellow) but have the same internal structure common to the respective image formation units. Therefore, in the following, only the composition and operation of the image formation unit 6BK will be described, and the description of the composition and operation of the image formation units 6M, 6C and 6Y that are the same as those of the image formation unit 6BK will be omitted.

The transporting belt 5 is an endless type belt which is wound between the driving roller 7 and the driven roller 8. The driving roller 7 is rotated by a drive motor (not shown). The drive motor, the driving roller 7 and the driven roller 8 function as a driving device which drives and moves the endless type transporting belt 5.

Upon starting of image formation, the uppermost one of recording sheets 4 stored in the paper tray 1 is sequentially sent out, and the transporting belt 5 is rotated while the recording sheet 4 is attracted to the transporting belt 5 through an electrostatic attracting action, so that the recording sheet 4 is first transported to the image formation unit 6BK. And, at the image formation unit 6BK, a toner image of black is transferred from the photoconductor drum to the recording sheet 5.

The image formation unit 68K includes a photoconductor drum 9BK as a photoconductor, and a charging unit 10BK, a developing unit 12BK, a photoconductor cleaner and a charge eliminating unit 13BK which are arranged around the photoconductor drum 9BK. The exposure unit 11 is arranged so that laser beams 14BK, 14M, 14C, 14Y, which correspond to the toner images of the colors formed by the image formation units 68K, 6M, 6C, 6Y, are emitted to the photoconductor drum 98K, 9M, 9C, 9Y, respectively.

Figure 2:
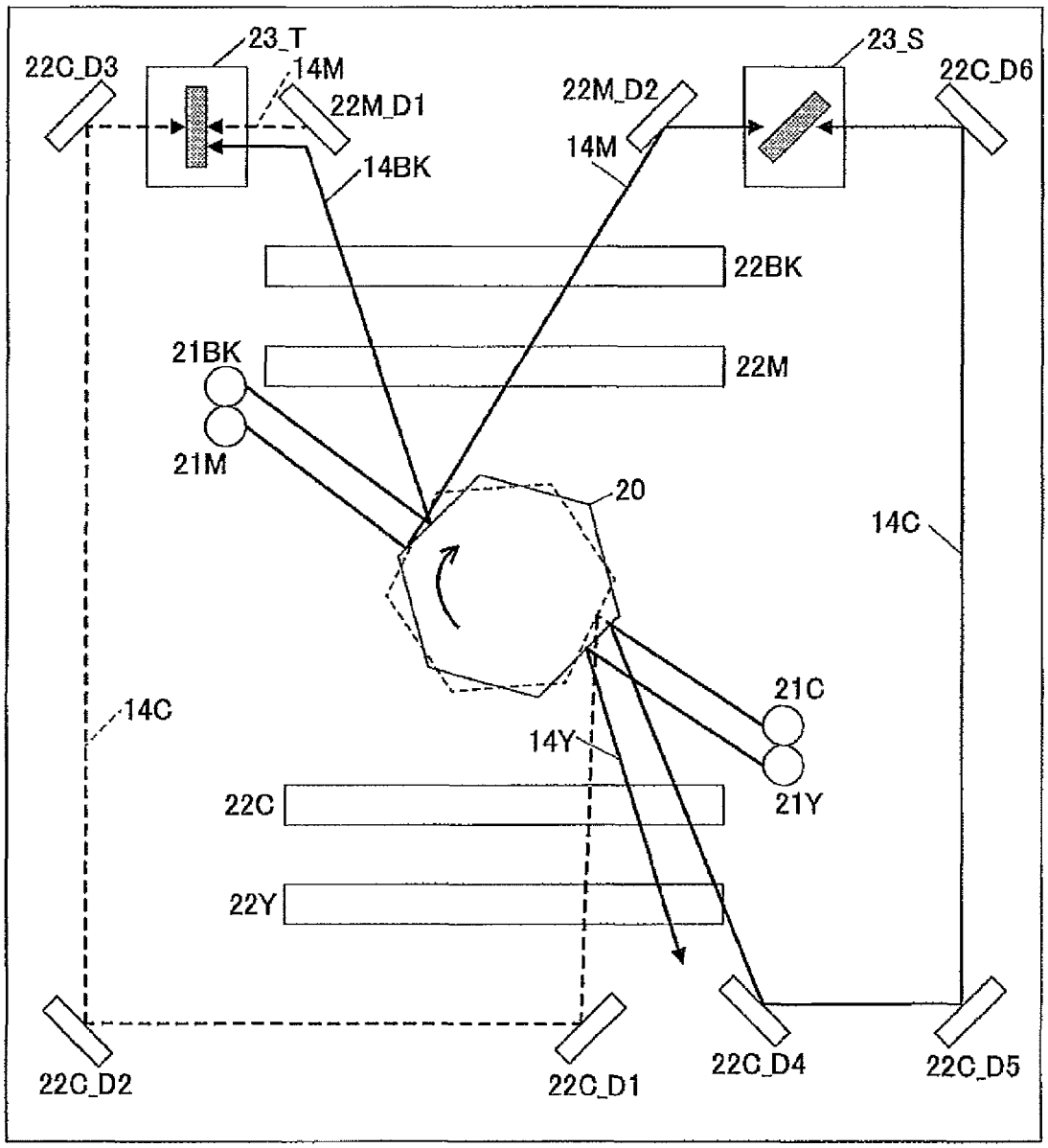
FIG. 2 is a diagram showing the internal structure of an exposure unit in an embodiment of the invention.

Next, the composition of an exposure unit 11 will be described with reference to FIG, 2. FIG. 2 is a diagram showing the internal structure of an exposure unit 11.

In the exposure unit 11 shown in FIG. 2, laser beams 14BK, 14M, 14C, 14Y are respectively irradiated from laser diodes 21BK, 21M, 21C, 21Y which are light source units. The irradiated laser beams 14BK, 14M, 14C, 14Y are reflected by a reflector mirror 20 to pass through optical systems 22BK, 22M, 22C, 22Y, respectively. After each optical path is adjusted, the laser beams are delivered to scan the surfaces of the photoconductor drums 9BK, 9M, 9C, 9Y, respectively.

The reflector mirror 20 is a polygon mirror with six reflection surfaces. By rotating the reflector mirror 20, one main scanning line of each laser beam on the photoconductor drum in the main scanning direction is formed for one reflection surface of the polygon mirror. In this embodiment, a single polygon mirror is arranged for the four laser diodes as the light source units.

Specifically, the two laser beams 14BK, 14M and the two laser beams 14C, 14Y are separately reflected by the opposite reflection surfaces of the rotating polygon mirror, so that the four photoconductor drums can be simultaneously exposed to the laser beams. Each of the optical systems 22BK, 22M, 22C, 22Y includes an f-θ lens which arranges the reflected light beams at equal intervals, and a deflector mirror which deflects each laser beam.

On the occasion of image formation, the outer surface of the photoconductor drum 9BK is uniformly charged by the charging unit 10BK in the dark, and the charged surface of the photoconductor drum 9BK is exposed to the laser beam 14BK (corresponding to the black image) delivered from the exposure unit 11, so that an electrostatic latent image is formed on the surface of the photoconductor drum 9BK. The developing unit 12BK visualizes this electrostatic latent image with black toner, so that a toner image of black is formed on the surface of the photoconductor drum 9BK.

This toner image is transferred to the recording sheet 4 by the transferring unit 15BK at the position (transfer position) where the photoconductor drum 9BK and the recording sheet 4 on transporting belt 5 are in contact. By this image transferring, the toner image of black is formed on the recording sheet 4.

The recording sheet 4 with the toner image of black transferred by the image formation unit 6BK as mentioned above is transported to the following image formation unit 6M by the transporting belt 5. In the image formation unit 6M, a toner image of magenta is formed on the photoconductor drum 9M through the image formation process that is the same as that in the image formation unit 6BK, and this toner image is superimposed and transferred to the toner image of black formed on the recording sheet 4.

The recording sheet 4 is further transported to the following image formation units 6C and 6Y, and a toner image of cyan formed on the photoconductor drum 9C and a toner image of yellow formed on the photoconductor drum 9Y are superimposed and transferred to the recording sheet 4 through the same operation.

In this manner, a full color image is formed on the recording sheet 4. After the recording sheet 4 with the full color image being formed is separated from the transporting belt 5, the image is fixed to the recording sheet 4 by the fixing unit 16, and it is ejected to the outside of the color-image forming device.

In the color image forming device including the deviation amount detecting device 100 of this embodiment, a deviation between the toner images of respective colors may take place such that the toner images of respective colors are not superimposed at the same position. When such a deviation takes place, it is necessary to correct the deviation between the toner images of respective colors. It is assumed that this deviation correction in this embodiment is carried out by aligning the image position of each of the toner images of magenta, cyan, yellow to the image position of the toner image of black as the reference position. Alternatively, the deviation correction may be carried out by using the image position of the toner image of another color than black as the reference position.

Figure 3:
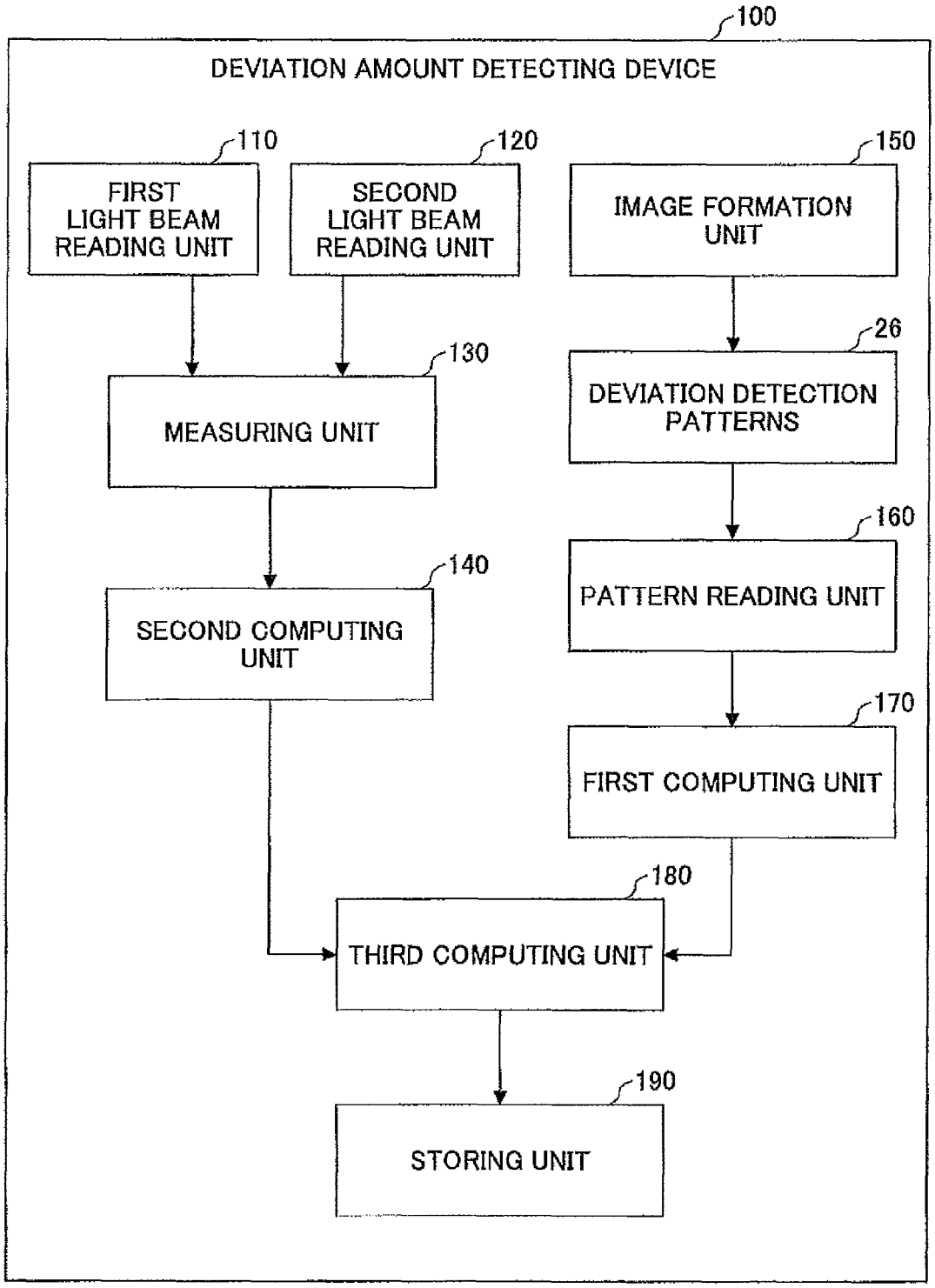
FIG. 3 is a diagram showing the composition of a deviation amount detecting device of an embodiment of the invention.

Next, the composition of a deviation amount detecting device of an embodiment of the invention will be described with reference to FIG. 3. FIG. 3 is a diagram showing the composition of a deviation amount detecting device 100 of an embodiment of the invention.

As shown in FIG. 3, the deviation amount detecting device 100 of this embodiment includes a first light beam reading unit 110, a second light beam reading unit 120, a measuring unit 130, a second computing unit 140, an image formation unit 150, a pattern reading unit 160, a first computing unit 170, a third computing unit 180, and a storing unit 190.

The first light beam reading unit 110 reads a light beam at a position corresponding to a start of one main scan of a main scanning direction. The first light beam reading unit 110 reads the light bean using a synchronous detecting sensor, and this synchronous detecting sensor is disposed at the position outside the imaging region, corresponding to the start of one main scan of the main scanning direction, and it is arranged to be perpendicular to the main scanning direction.

The second light beam reading unit 120 reads a light beam at a position corresponding to an end of one main scan of a main scanning direction. The second light beam reading unit 120 reads the light beam using a synchronous detecting sensor, and this synchronous detecting sensor is disposed at the position outside the imaging region, corresponding to the end of one main scan of the main scanning direction, and it is arranged to have an inclination angle of $\pi/4$ to the main scanning direction.

Alternatively, the synchronous detecting sensor used by the second light beam reading unit 120 may be arranged to have a predetermined inclination angle, which is different from $\pi/4$, with respect to the main scanning direction. Alternatively, the synchronous detecting sensor used by the first light beam reading unit 110 may be arranged to have a predetermined inclination angle to the main scanning direction and the synchronous detecting sensor used by the second light beam reading unit 120 may be arranged to be perpendicular to the main scanning direction.

The measuring unit 130 measures a scanning time between a time the light beam is read by the first light beam reading unit 110 and a time the light beam is read by the second light beam reading unit 120.

The second computing unit 140 computes an amount of change of the scanning time, after the measuring unit 130 measures the scanning time over multiple times, and computes an amount of deviation by multiplying the computed amount of change by a scanning speed of the light beam. The amount of deviation computed by the second computing unit 140 contains both an amount of deviation of the main scanning direction (main deviation amount) and an amount of deviation of the sub-scanning direction (sub-deviation amount) in a mixed manner.

It is assumed that, in this embodiment, the main scanning direction means the direction in which the scanning is performed by a light beam, and the sub-scanning direction means the transporting direction of a transporting member or an intermediate transfer belt, which direction is perpendicular to the main scanning direction.

Next, the principle of computing the amount of deviation by the second computing unit 140 will be explained with reference to FIG. 2.

In FIG. 2, the synchronous detecting sensors are indicated by 23_T and 23_S, and the loopback mirrors for synchronous detection are indicated by 22C_D1, 22C_D2, 22C_D3, 22C_D4, 22C_D5, 22C_D6, 22M_D1, and 22M_D2.

The synchronous detecting sensor 23_T is disposed at the position outside the imaging region, corresponding to the start of one main scan of the main scanning direction, and the synchronous detecting sensor 23_S is disposed at the position outside the imaging region, corresponding to the end of one main scan of the main scanning direction. A light receiving part of the synchronous detecting sensor 23_T is arranged to be perpendicular to the main scanning direction, and a light receiving part of the synchronous detecting sensor 23_S is arranged to have an inclination angle of $\pi/4$ to the main scanning direction.

The synchronous detecting sensor 23_T detects laser beams 14BK, 14M and 14C for every main scan and adjusts the exposure start timing at a start of image formation. A laser beam 14C enters the synchronous detecting sensor 23_T via the mirrors 22C_D1, 22C_D2 and 22C_D3. On the other hand, a laser beam 14Y is not detected by the synchronous detecting sensor 23_T and adjustment of the write start timing cannot be performed by the synchronous detecting sensor 23_T. For this reason, the exposure start timing of yellow is set to coincide with the exposure start timing of cyan, so that the image positions of the respective colors are aligned.

In this embodiment, the synchronous detecting sensor 23_T detects a laser beam 14BK. This is because the image forming device is adapted for the case of black monochrome printing.

Similarly, the synchronous detecting sensor 23_S detects laser beams 14M and 14C for every main scan. After a laser beam 14C enters the synchronous detecting sensor 23_T, its path is changed by the rotation of the polygon mirror 20, and a laser beam 14C enters the synchronous detecting sensor 23_S via the loopback mirrors 22C_D4, 22C_D5 and 22C_D6.

The synchronous detecting sensors 23_T and 23_S In this embodiment perform only the detection of laser beams 14M and 14C, and the detection of the amount of deviation for magenta and cyan based on the amount of change of the scanning time can be performed. However, the detection for yellow cannot be performed.

The measuring unit 130 measures a scanning time between a time a laser beam 14M or 14C is detected by the synchronous detecting sensor 23_T and a time a laser beam 14M or 14C is detected by the synchronous detecting sensor 23_S.

Generally, the scanning time measured by the measuring unit 130 has the characteristics that it changes with the exposure position of the sub-scanning direction of laser beam 14M or 14C, and the magnification of the main scanning direction of the f-θ lens. Namely, when the internal temperature of the exposure unit 11 rises to a high temperature and the shape and position of the optical system 22 change, the scanning time of laser beam 14M or 14C detected by the synchronous detecting sensor 23_T and the synchronous detecting sensor 23_S also changes. Therefore, the amount of change of the scanning time measured by the measuring unit 130 over multiple times is computed by the second computing unit 140, and it is possible to detect the amount of deviation of the sub-scanning direction resulting from a change of the exposure position of laser beam 14, and the amount of deviation of the main scanning direction resulting from a change of the scanning magnification of the f-θ lens.

The image formation unit 150 forms the deviation detection patterns for detecting an amount of deviation between the image position of a specific color in the tandem type color image forming device and the image position of a color other than the specific color, on the transporting member or the intermediate transfer belt.

The pattern reading unit 160 includes a sensor which reads the deviation detection patterns formed on the transporting member or the intermediate transfer belt by the image formation unit 150.

The first computing unit 170 computes a main deviation amount and a sub-deviation amount respectively based on the position information of the deviation detection patterns read by the pattern reading unit 160. The composition and function of the first computing unit 170 will be described later.

In the deviation amount detecting device 100 of this embodiment, the deviation compensation is temporarily performed by the first computing unit 170, and the respective image positions of black, magenta, cyan and yellow are arranged. The second computing unit 140 sets the scanning time by the synchronous detecting sensors 23_T and 23_S, which scanning time is measured by the measuring unit 130 during the deviation compensation by the first computing unit 170, to a reference value.

The third computing unit 180 corrects the value computed by the second computing unit 140, based on the amount of deviation computed by the first computing unit 170, and the third computing unit 180 computes the main deviation amount and the sub-deviation amount, respectively.

Specifically, the third computing unit 180 computes a ratio (which will be called first correction coefficient $\alpha$) of the sub-deviation amount (computed by the first computing unit 170) to a sum of the main deviation amount and the sub-deviation amount (both computed by the first computing unit 170).

The first correction coefficient a denotes the ratio of the sub-deviation amount and the main deviation amount contained in the deviation amount computed by the second computing unit 140 during the synchronous detection.

Next, the third computing unit 180 computes a ratio (which will be called second correction coefficient $\beta$) of the amount of deviation computed by the second computing unit 140 to the sum of the main deviation amount and the sub-deviation amount both computed by the first computing unit 170.

The second correction coefficient $\beta$ denotes the ratio of the sum of the main deviation amount and the sub-deviation amount both computed with the deviation detection patterns and the sum of the main deviation amount and the sub-deviation amount computed with the synchronous detection signals.

Next, the third computing unit 180 computes a second correction coefficient β over multiple times, and computes an amount of change (which will be called third correction coefficient γ) of the second correction coefficient β.

The third correction coefficient γ denotes the ratio of β currently computed by the third computing unit 180 and the value of β previously computed by the third computing unit 180.

The deviation amount detecting device 100 of this embodiment computes the amount of deviation by using the deviation detection patterns repeatedly at intervals (cycles) of a predetermined time. During an inter-cycle period in which the computation of the amount of deviation using the deviation detection patterns is held in a waiting state, the deviation amount detecting device 100 corrects the amount of deviation (which is computed by the second computing unit 140) by using the correction coefficients α, β and γ obtained based on the result of the latest detection cycle.

Although the amount of deviation computed based on the synchronous detection signals contains both the main deviation amount and the sub-deviation amount in a mixed manner, the deviation amount detecting device 100 of this embodiment is able to separately determine the main deviation amount and the sub-deviation amount using the correction coefficients α, β and γ. Accordingly, the deviation amount detecting device 100 of this embodiment is able to establish good detection accuracy of the thus isolated main deviation amount and the sub-deviation amount, and this accuracy is equivalent to the detection accuracy of the amount of deviation of the sub-scanning direction that is detected using the deviation detection patterns.

The third computing unit 180 computes the amount of deviation of the main scanning direction and the amount of deviation of the sub-scanning direction repeatedly within one cycle of the predetermined time. In the following, a first half part of the predetermined time is called a first phase, and a second half part of the predetermined time is called a second phase.

The first phase and the second phase may be predetermined to be equal to each other. For example, if the detection of the amount of deviation using the deviation detection patterns 26 is performed at intervals of 30 minutes, the first phase and the second phase in this case are predetermined such that each phase is equal to 15 minutes.

Alternatively, an appropriate ratio of the first phase and the second phase may be predetermined. For example, if the detection of the amount of deviation using the deviation detection patterns 26 is performed at intervals of 30 minutes, the first phase is predetermined to be equal to 20 minutes and the second phase is predetermined to be equal to 10 minutes.

During the first phase, the third computing unit 180 corrects the amount of deviation of the sub-scanning direction by multiplying the amount of deviation (computed by the second computing unit) by the correction coefficients α and β. Moreover, the third computing unit 180 corrects the amount of deviation of the main scanning direction by multiplying the amount of deviation (computed by the second computing unit) by the value of (1−the first correction coefficient α) and the correction coefficient β. Namely, the corrected amount of deviation of the sub-scanning direction=the amount of deviation computed by the second computing unit 140×α×β; and the corrected amount of deviation of the main scanning direction=the amount of deviation computed by the second computing unit 140×(1−α)×β.

Furthermore, during the second phase, the third computing unit 180 corrects the amount of deviation of the sub-scanning direction by multiplying the amount of deviation (computed by the second computing unit) by the correction coefficients α, β and γ. Moreover, the third computing unit 180 corrects the amount of deviation of the main scanning direction by multiplying the amount of deviation (computed by the second computing unit) by the value of (1−the first correction coefficient α), the correction coefficient β, and the correction coefficient γ. Namely, the corrected amount of deviation of the sub-scanning direction=the amount of deviation computed by the second computing unit 140×α×β×γ; and the corrected amount of deviation of the main scanning direction=the amount of deviation computed by the second computing unit 140×(1−α)×β×γ.

For every color, the deviation amount detecting device 100 computes the first correction coefficient α, the second correction coefficient β and the third correction coefficient γ, and computes the amount of deviation for every color using the computed correction coefficients The storing unit 190 stores the amount of deviation of the main scanning direction and the amount of deviation of the sub-scanning direction computed by the third computing unit 180 into a storage device.

Figure 4:
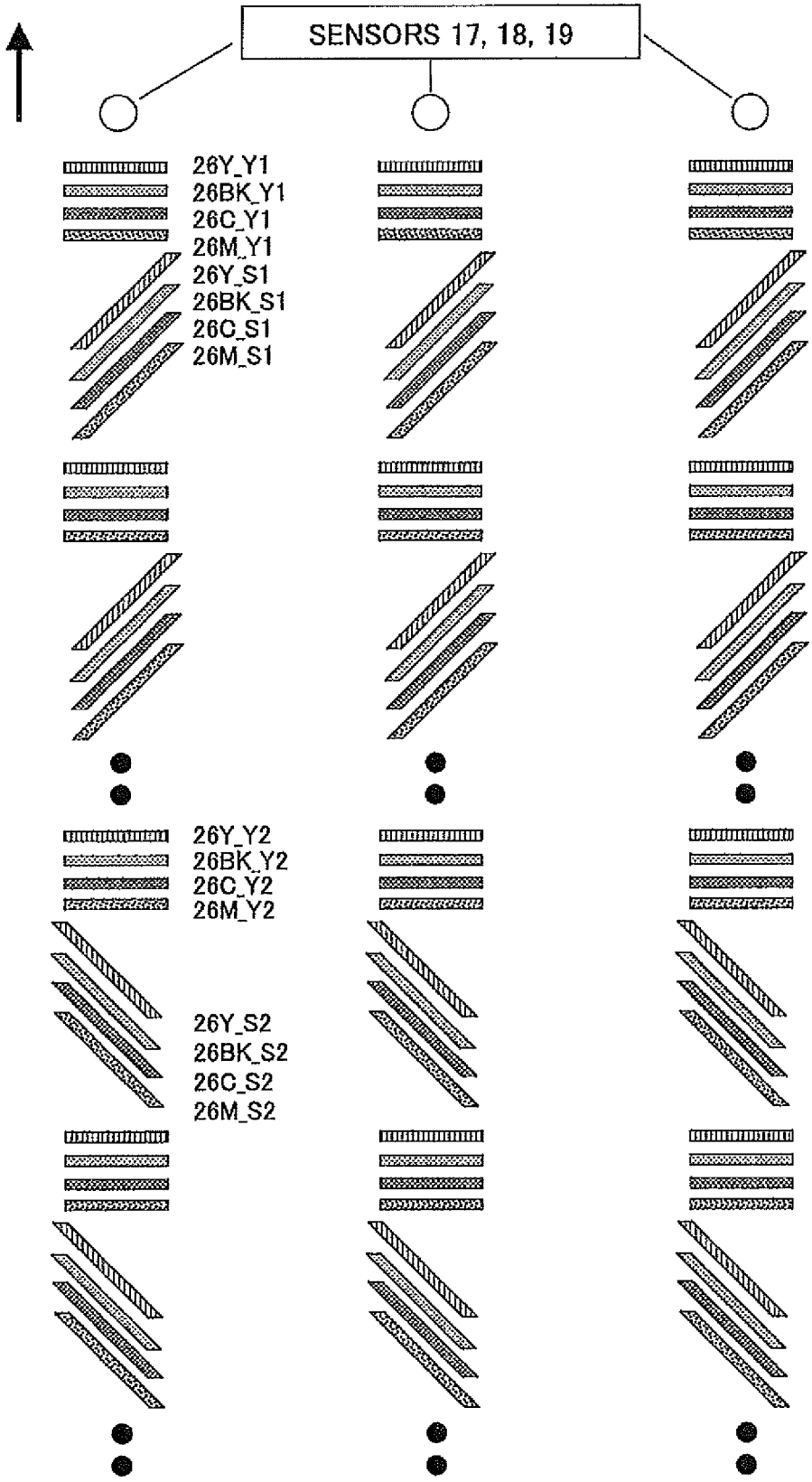
FIG. 4 is a diagram showing an example of deviation detection patterns in an embodiment of the invention.

Next, the deviation detection patterns will be described with reference to FIG. 4. FIG. 4 is a diagram showing an example of deviation detection patterns 26 in an embodiment of the invention.

As shown in FIG. 4, the deviation detection patterns 26 are formed of four colors of black, magenta, cyan and yellow. The deviation detection patterns 26 include various sets of deviation detection patterns, each set including combinations of: first deviation detection patterns (26BK_Y1, 26M_Y1, 26C_Y1, 26Y_Y1) which are four horizontal line patterns parallel to the main scanning direction; second deviation detection patterns (26BK_S1, 26M_S1, 26C_S1, 26Y_S1) which are four slanting line patterns having an inclination angle of π/4 to the main scanning direction; first deviation detection patterns (26BK_Y2, 26M_Y2, 26C_Y2, 26Y_Y2) which are four horizontal line patterns parallel to the main scanning direction; and third deviation detection patterns (26BK_S2, 26M_S2, 26C_S2, 26Y_S2) which are four slanting line patterns having an inclination angle of 3π/4 to the main scanning direction.

The intervals between the sets of the deviation detection patterns in the transporting direction are equal to one third of the length of the outer circumference of each of the photoconductor drums 9BK, 9M, 9C and 9Y, and equal to one half of the length of the outer circumference of the driving roller 7.

With the thus constructed deviation detection patterns 26, three sets of deviation detection patterns 26 can be formed over one cycle of each photoconductor drum 9, and fluctuations of the amount of deviation due to the unevenness of the rotation of each photoconductor drum 9 can be canceled by averaging the amounts of deviation detected. Similarly, two sets of deviation detection patterns 26 can be formed over one cycle of the driving roller 7.

The deviation amount detecting device 100 of this embodiment is arranged to form 24 sets of the deviation detection patterns 26 along the transporting direction, each set combining the eight first deviation detection patterns, the four second deviation detection patterns and the four third deviation detection patterns. The length of the thus formed deviation detection patterns 26 is equal to the peripheral length of the transporting belt 5, and the detection error due to the unevenness of the thickness of the transporting belt 5 can be canceled.

Among the 24 sets of deviation detection patterns 26 shown in FIG. 4, the first-half of 12 sets contain only the second deviation detection patterns, and the second half of 12 sets contains only the third deviation detection patterns. The interval of the 12 sets of the first half in the transporting direction is equal to that of the 12 sets of the second half, and the cycle of the 12 sets of both in the transporting direction is equal to four cycles of the photoconductor drum 9, and equal to six cycles of the driving roller 7.

The sets containing the second deviation detection patterns or the third deviation detection patterns are formed continuously over more than one cycle of the photoconductor drum 9 and the driving roller 7, the rotation unevenness can be offset by he respective sets containing the second deviation detection patterns or the third deviation detection patterns.

In the deviation amount detecting device 100 of this embodiment, the deviation detection patterns 26 are formed as toner images of yellow, black, magenta and cyan on the transporting belt 5 through the printing process that is the same as the previously described printing process of forming a color image on the recording sheet 4. The image formation unit 150 in this embodiment includes the image formation units 6BK, 6M, 6C and 6Y used in the color image forming device.

In another embodiment of this invention, the transporting belt 5 on which the deviation detection patterns 26 are formed may be an intermediate transfer belt, and the image formation unit 150 in such an embodiment may form the deviation detection patterns on the intermediate transfer belt.

Figure 5:
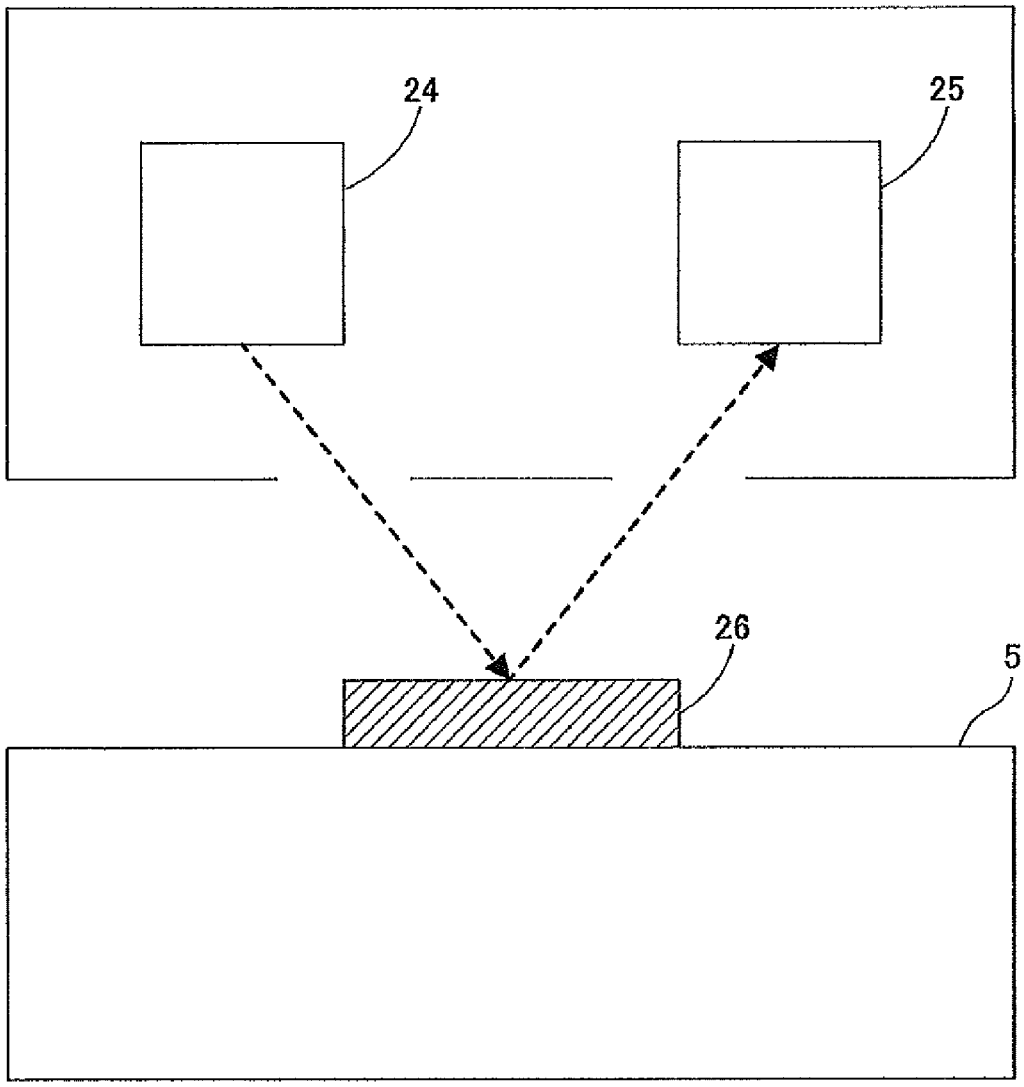
FIG. 5 is an enlarged diagram showing the composition of a sensor included in a pattern reading unit in an embodiment of the invention.

Next, the composition and operation of a sensor included in a pattern reading unit of a deviation amount detecting device 100 of an embodiment of the invention will be described with reference to FIG. 5 and FIG. 6. FIG. 5 is an enlarged diagram showing one of the sensors 17, 18 and 19, and FIG. 6 is a diagram showing the sensors 17, 18 and 19 included in the pattern reading unit.

As shown in FIG. 5, the sensor 17 (18, 19) includes a light emitting part 24 and a light receiving part 25. The light emitting part 24 emits an irradiation light to the transporting belt 5. The light receiving part 25 receives a reflected light from a deviation detection pattern 26 formed on the transporting belt 5. The sensor 17 (18, 19) detects the deviation detection pattern 26 from the received reflected light.

Figure 6:
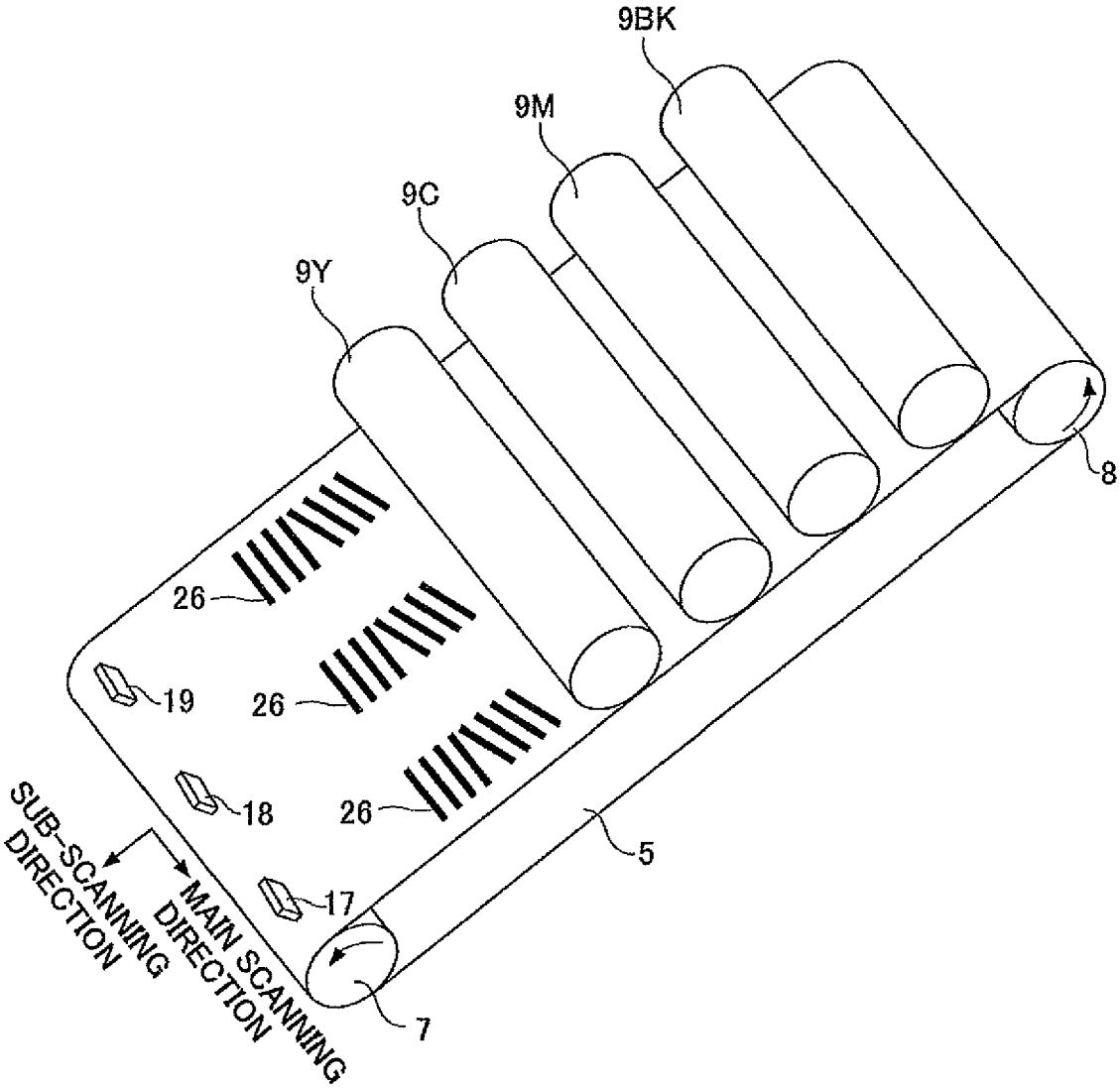
FIG. 6 is a diagram showing the sensors included in the pattern reading unit.

As shown in FIG. 6, the sensors 17, 18 and 19 are disposed on the downstream side of the image formation unit 6Y so that they face the transporting belt 5. The sensors 17, 18 and 19 are supported on the same substrate so that they are arranged in a line parallel to the main scanning direction.

Figure 7:
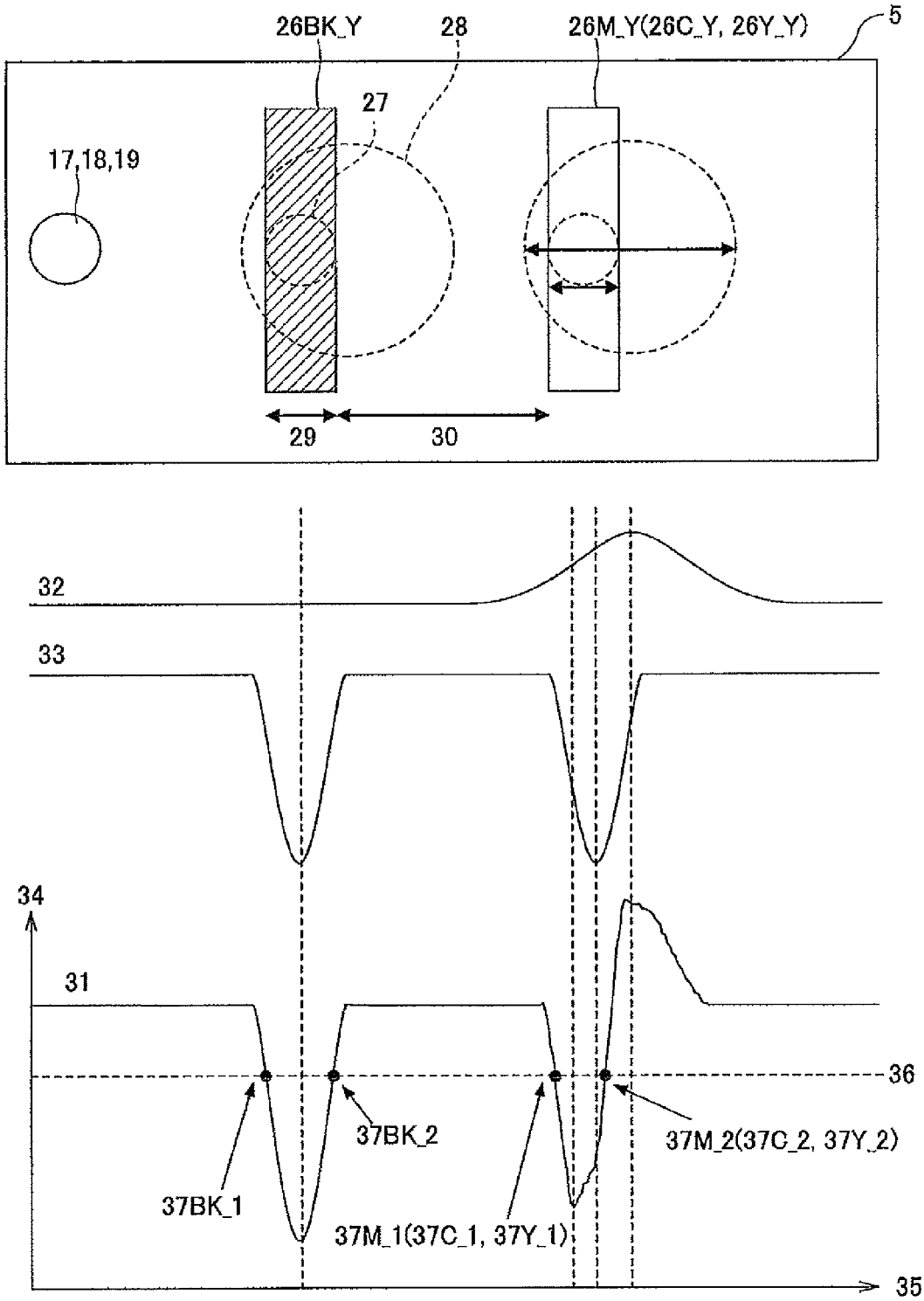
FIG. 7 is a diagram for explaining the principle of detecting deviation detection patterns by the sensor included in the pattern reading unit.

Next, the principle of detecting the deviation detection patterns will be described with reference to FIG. 7. FIG. 7 is a diagram for explaining the principle of detecting the deviation detection patterns 26 by the sensor 17 (18, 19).

In FIG. 7, the curve 31 denotes the detection result of reflected light received by the light receiving part 25, the curve 32 denotes the detection intensity of diffused reflected light received by the light receiving part 25, and the curve 33 denotes the detection intensity of normal reflected light received by the light receiving part 25. The detection result (the curve 31) of reflected light received by the light receiving part 25 is equal to the sum of the detection intensity (the curve 32) of diffused reflected light received by the light receiving part 25 and the detection intensity (the curve 33) of normal reflected light received by the light receiving part 25.

The vertical axis 34 in FIG. 7 indicates the light receiving intensity of the light receiving part 25, and the horizontal axis 35 indicates the elapsed time. The normal reflected light means reflected light which is reflected in the direction opposite to the incidence direction and at the angle that is the same as the incident angle of an incident light (namely, the angle of reflection of the reflected light is indicated by ($\pi-\theta$) where the incident angle is set to $\theta$), and the diffused reflected light means reflected light other than the normal reflected light.

In FIG. 7, reference numeral 36 denotes a predetermined threshold of the light receiving part 25 of the sensor 17 (18, 19). As shown in FIG. 7, the sensor 17 (18, 19) detects an edge of the deviation detection pattern 26 at each of positions 37BK_, 37BK_2, 37M_1 (37C_1, 37Y_1) and 37M_2 (37C_2, 37Y_2) where the detection result 31 of the reflected light intersects the line indicated by the threshold 36. In this embodiment, the middle point of two edges detected from each of the deviation detection patterns 26 (for example, the middle point of 37BK_1 and 37BK_2) is determined as being an image position of the pattern.

Alternatively, any of edges 37BK_1, 37B_2, 37M_1 (37C_1, 37Y_1) and 37M_2 (37C_2, 37Y_2) detected from each of the deviation detection patterns 26 may be determined as being an image position of the pattern.

In order to improve a S/N ratio (the ratio of the intensity of a signal to be detected to the intensity of the noise) at the time of detecting the deviation detection patterns, it is necessary that the line width 29 of each of the deviation detection patterns in the transporting direction be nearly equal to a width of the light receivable region 27 (the spot diameter of the photo diode) of the light receiving part 25.

Diffused light beams are simultaneously reflected from two patterns if irradiation light is emitted to two deviation detection patterns simultaneously. In such a case, it is impossible to detect one pattern normally. To avoid this, it is necessary to set the distance 30 between two deviation detection patterns to be larger than the spot diameter 28 of the irradiation light.

Figure 8:
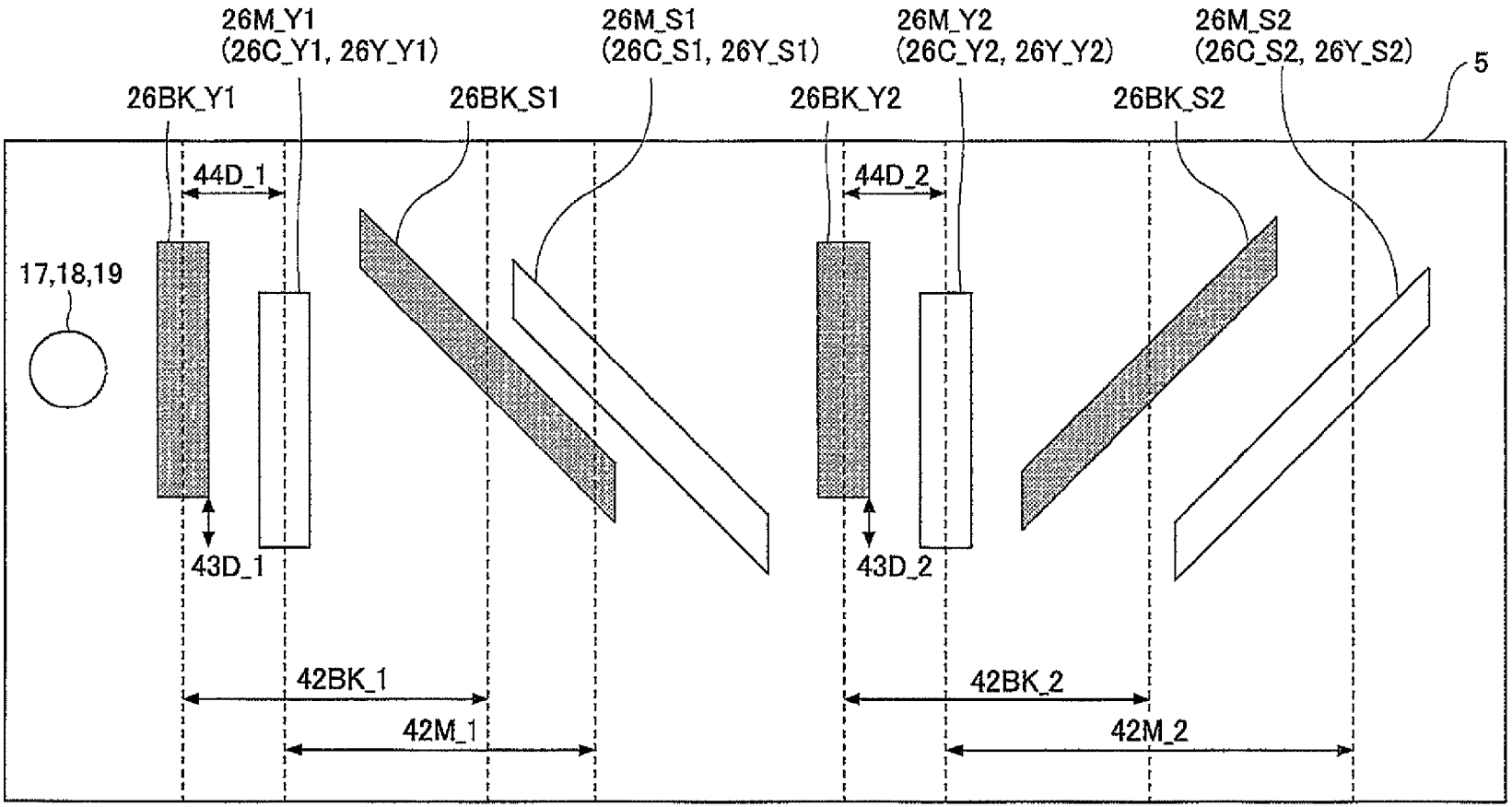
FIG. 8 is a diagram for explaining the principle of computing an amount of deviation using the deviation detection patterns.

Next, the computation of the amount of deviation using the deviation detection patterns will be described with reference to FIG. 8. FIG. 8 is a diagram for explaining the principle of computing the amount of deviation using the deviation detection patterns.

In the example shown in FIG. 8, the amount of deviation for the image of magenta is computed from deviation detection patterns 26 of black and magenta by setting the image of black as a reference image. Similarly, if the deviation detection pattern of magenta is replaced by one of the deviation detection patterns of cyan and yellow, the amount of deviation for the image of cyan or yellow with respect to the image of black as the reference image can be computed.

In FIG. 8, a sensor 17 (18, 19), first deviation detection patterns 26BK_Y1, 26BK_Y2 of black, first deviation detection patterns 26M_Y1, 26M_Y2 of magenta, a second deviation detection pattern 26BK_S1 of black, a second deviation detection pattern 26M_S1 of magenta, a third deviation detection pattern 26BK_S2 of black, and a third deviation detection pattern 26M_S2 of magenta are illustrated. The arrow 42BK_1 in FIG. 8 denotes a distance between the first deviation detection pattern 26BK_Y1 of black and the second deviation detection pattern 26BK_S1 of black. The arrow 42BK_2 in FIG. B denotes a distance between the first deviation detection pattern 26BK_Y2 of black and the third deviation detection pattern 26BK_S2 of black. The arrow 42M_1 in FIG. 8 denotes a distance between the first deviation detection pattern 26M_Y1 of magenta and the second deviation detection pattern 26M_S1 of magenta. The arrow 42M_2 in FIG. 8 denotes a distance between the first deviation detection patterns 26M_Y2 of magenta and the third deviation detection pattern 26M_S2 of magenta.

It is assumed that the position of each deviation detection pattern needed for computing the distance between the above-mentioned deviation detection patterns is the midpoint between the front-end edge and the rear-end edge of each detection pattern which is detected by the sensor 17.

The deviation amounts 43D_1 and 43D_2 of the main scanning direction computed from the respective deviation detection patterns are represented by the formulas: 43D_1=42BK_1−42M_1 and 43D_2=42M_2−42BK_2 because the inclination angles to the main scanning direction of the second deviation detection pattern 26M_S1 of magenta and the third deviation detection pattern 26M_S2 of magenta are equal to $\pi/4$ and $3\pi/4$, respectively.

The deviation amount 43D of the main scanning direction of the magenta image to the black image is represented by the average of 43D_1 and 43D_2: 43D=(43D_1+43D_2)/2. The deviation amount 44D of the sub-scanning direction of the magenta image to the black image is determined by computing a difference between the detection value 44D_1 (44D_2) of the distance of the first deviation detection pattern 26BK_Y1 of black and the first deviation detection pattern 26M_Y1 of magenta and the desired distance (to be originally created by the deviation amount detecting device 100) of the first deviation detection pattern 26BK_Y1 of black and the first deviation detection pattern 26M_Y1 of magenta.

Figure 9:
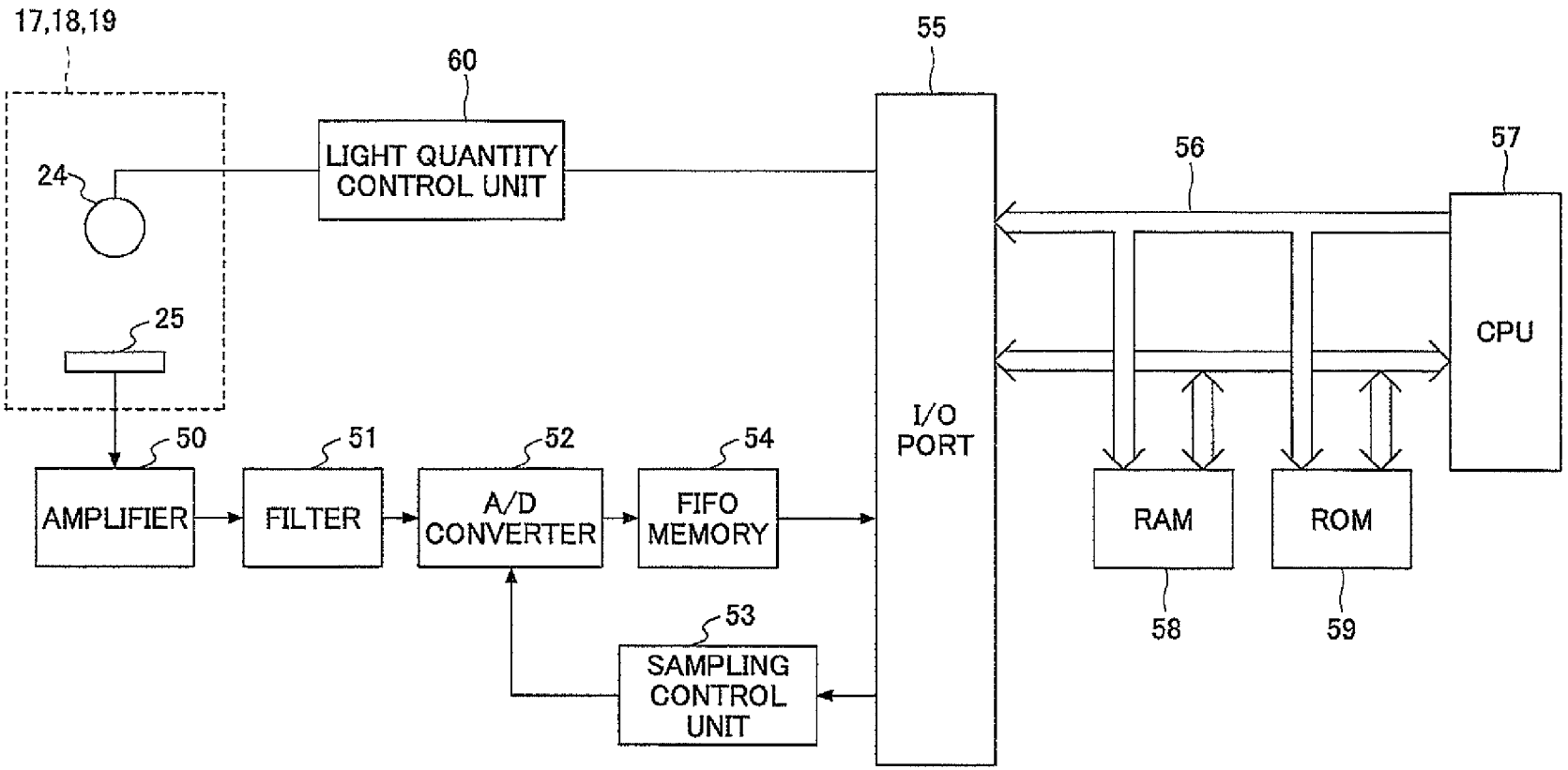
FIG. 9 is a diagram showing the composition of a first computing unit of a deviation amount detecting device of an embodiment of the invention.

Next, the composition and operation of the first computing unit of a deviation amount detecting device of an embodiment of the invention will be described with reference to FIG. 9. FIG. 9 is a diagram showing the composition of the first computing unit 170 in the deviation amount detecting device 100 of this embodiment.

The first computing unit 170 in this embodiment includes an amplifier 50, a filter 51, an A/D (analog-to-digital) converter 52, a sampling control unit 53, an FIFO (first-in first-out) memory 54, an I/O (input/output) port 55, a data bus 56, a CPU (central processing unit) 57, a RAM (random access memory) 58, a ROM (read-only memory) 59, and a light quantity control unit 60.

The signal of reflected light received by the light receiving part 25 is amplified by the amplifier 50. Only the signal component needed for detecting the deviation detection patterns 26 is extracted from the amplified signal using the filter 51.

Next, the signal component of the reflected light signal from the filter 51 is converted from analog data into digital data by the A/D converter 52. The sampling of the data in this A/D conversion is controlled by the sampling control unit 53, and the sampled signal is stored in the FIFO memory 54.

After the detection of the deviation detection patterns 26 of all the four colors of black, magenta, cyan and yellow is completed, the data stored in the FIFO memory 54 is loaded to the RAM 58 via the I/O port 55 and the data bus 56. The CPU 57 performs data processing in which the above-described computation of the amount of deviation is carried out with respect to the data loaded to the RAM 58.

In the ROM 59, the program for performing the above-described computation of the amount of deviation and the various programs for controlling the deviation amount detecting device of this embodiment are stored beforehand. The CPU 57 monitors the detection signal from the light receiving part 25 at an appropriate time, and controls the light quantity by using the light quantity control unit 60, so that the intensity of the light receiving signal from the light receiving part 25 is maintained at a fixed level, in order to accurately detect the deviation amount even if degradation of the transporting belt 5 and the emitting part 24 takes place. Thus, the CPU 57 and the ROM 59 function as a control unit which controls operation of the entire deviation amount detecting device 100 of this embodiment.

Figure 10:
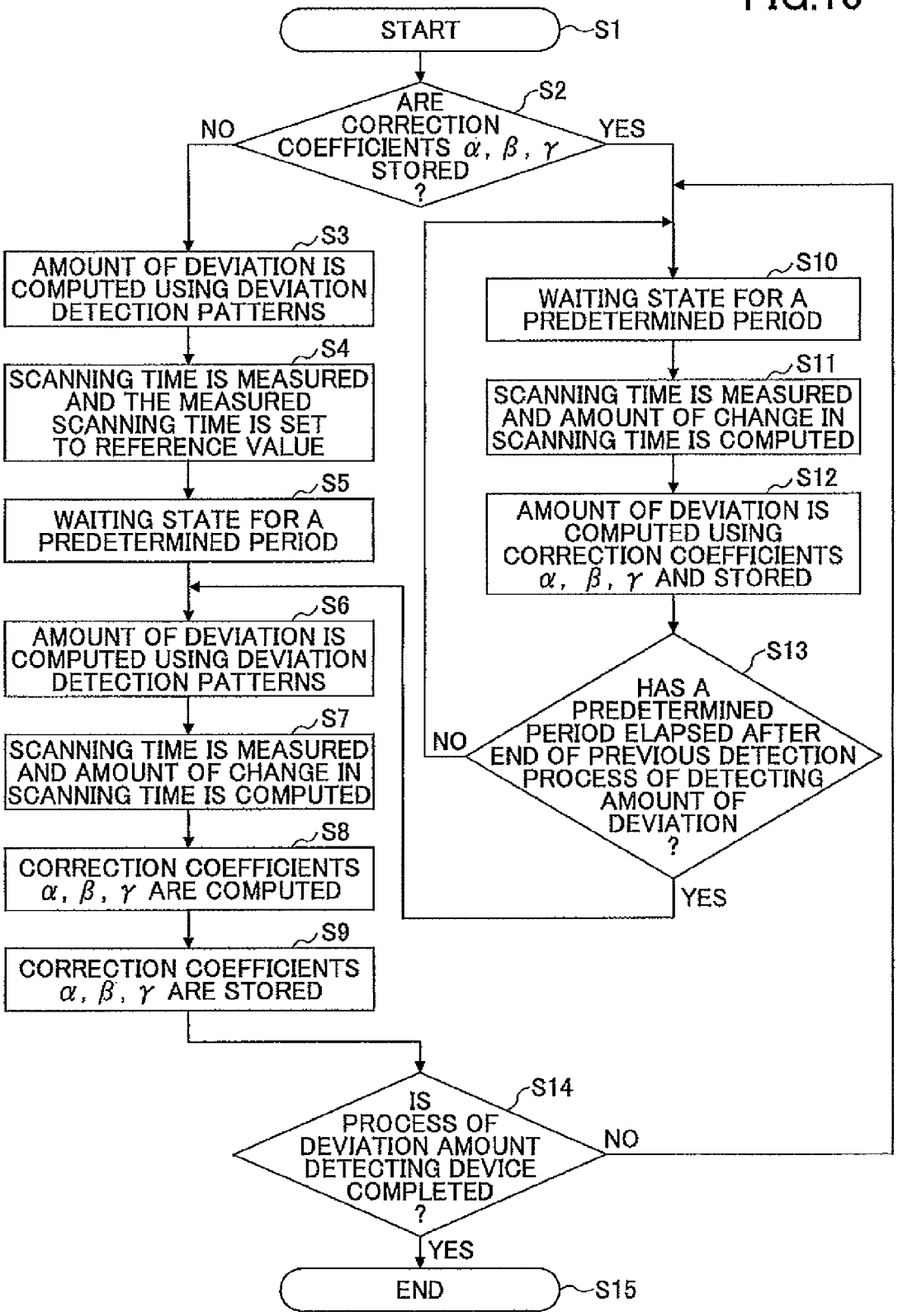
FIG. 10 is a flowchart for explaining the process of computing the amount of deviation by a deviation amount detecting device of an embodiment of the invention.

Next, the process of computation of the amount of deviation by a deviation amount detecting device of an embodiment of the invention will be described with reference to FIG. 10. FIG. 10 is a flowchart for explaining the process of computing the amount of deviation by the deviation amount detecting device 100 of this embodiment.

In the flowchart of FIG. 10, the process of detection by the deviation amount detecting device 100 of this embodiment is started at S1. In step S2, it is determined whether the correction coefficients $\alpha$, $\beta$ and $\gamma$ are stored in the storage device by the storing unit.

After the correction coefficients $\alpha$, $\beta$ and $\gamma$ are stored in step S2, the control unit is set in S10 in a waiting state for a predetermined period (for example, 1 minute). This period is an execution cycle of the process of detecting the amount of deviation using the synchronous detecting sensors 23_T and 23_S.

When the correction coefficients $\alpha$, $\beta$ and $\gamma$ are not stored in step S2, the computation of the amount of deviation using the deviation detection patterns 26 is performed in step S3.

First, the image formation unit 150 forms deviation detection patterns 26 on the transporting member as shown in FIG. 4. Next, the pattern reading unit 160 (the sensors 17, 18 and 19) reads the deviation detection patterns 26, and the position information of the deviation detection patterns 26 is stored in the RAM 58.

Next, the first computing unit 170 computes the deviation amount 43D_1 for each color of magenta, cyan and yellow based on the position information of the first deviation detection patterns and the second deviation detection patterns (the 12 sets of the first half in FIG. 4) stored in the RAM 58. In the case of magenta, the deviation amount 43D_1 (FIG. 8) is computed repeatedly for each set of the deviation detection patterns of black and magenta contained in the 12 sets of the first half (FIG. 4), and the average of these amounts is computed. Similarly, the same computation is performed for cyan and yellow.

The first computing unit 170 computes the deviation amount 43D_2 for each color of magenta, cyan and yellow based on the position information of the first deviation detection patterns and the third deviation detection patterns (the 12 sets of the second half in FIG. 4) stored in the RAM 58. In the case of magenta, the deviation amount 43D_2 (FIG. 8) is computed repeatedly for every set of the deviation detection patterns of black and magenta contained in the 12 sets of the second half (FIG. 4), and the average of these amounts is computed. Similarly, the same computation is performed for cyan and yellow. The average 43D of 43D_1 and 43D_2 is computed for each color of magenta, cyan and yellow. This average 43D is the amount of deviation of the main scanning direction computed by the first computing unit 170.

Simultaneously, the first computing unit 170 computes the deviation amount 44D of each image of magenta, cyan and yellow from the black image in the transporting direction. In the computation of the deviation amount 44D, the deviation amounts 44D_1 and 44D_2 in FIG. 8 are computed based on the detection results of all the deviation detection patterns for every color of magenta, cyan and yellow, and the average 44D of the deviation amounts 44D_1 and 44D_2 is computed. This average 44D is the amount of deviation of the sub-scanning direction computed by the first computing unit 170.

The amounts of deviation of the main scanning direction and the sub-scanning direction of each color image position will be corrected using the amount of deviation computed in step S3. Each process of detecting the amount of deviation using 1S the correction coefficients α, β and γ is performed for every color.

In step S4, the first light beam reading unit 110 and the second light beam reading unit 120 detect the laser beam 14 by using the synchronous detecting sensors 23_T and 23_S. The measuring unit 130 measures the scanning time of the laser beam 14 detected by the synchronous detecting sensors 23_T and 23_S. The second computing unit 140 sets the scanning time measured by the measuring unit 130 to a reference value.

In step S5, the control unit is set in a waiting state for a predetermined period (for example, 5 minutes). The waiting state is continuously held until the following cycle of detecting the amount of deviation using the deviation detection patterns 26 is started.

In step S6, the computation of the amount of deviation using the deviation detection patterns 26 (which is the same as the process performed in the step S3) is performed again.

In step S7, the measurement of the scanning time of laser beam 14 using the synchronous detecting sensors 23_T and 23_S (which is the same as the process performed in the step S4) is performed again. The second computing unit 140 computes an amount of change of the scanning time between the scanning time measured in the step S4 and the scanning time measured in this step S7. At this time, the measuring unit 130 measures the scanning time of laser beam 14 detected by the synchronous detecting sensors 23_T and 23_S, and the second computing unit 140 sets the currently measured scanning time to a new reference value. The previous reference value is deleted.

Moreover, in step S7, the second computing unit 140 computes an amount of deviation by multiplying the computed amount of change by the scanning speed of the laser beam 14. The amount of deviation computed in the step 57 contains both the main deviation amount and the sub-deviation amount.

In step S8, the third computing unit 180 computes the correction coefficients α, β and γ. The computation of the correction coefficients α, β and γ is performed as described above. At this time, the third correction coefficient γ cannot be computed when the second correction coefficient β is computed for the first time. In such a case, the third computing unit 180 sets the initial value 1 to the third correction coefficient γ.

In step S9, the correction coefficients α, β and γ computed by the third computing unit 180 are stored in the RAM 58.

In step S14, it is determined whether the process of computation by the deviation amount detecting device 100 is completed. When the result of the determination in step S14 is affirmative, the process of computation of FIG. 10 is terminated (S15). When the result of the determination in step S14 is negative, the control shifts to the step S10.

After the waiting state of the predetermined period in the step S10 is completed, in step S11, the reading of laser beam 14 using the synchronous detecting sensors 23_T and 23_S is performed again. The measuring unit 130 measures the scanning time of the laser beam 14 again in step S11.

Moreover, in step S11, the second computing unit 140 computes an amount of change of the scanning time between the scanning time measured in the step S7 and the scanning time measured in the step S11.

In step S12, the second computing unit 140 computes an amount of deviation by multiplying the amount of change of the scanning time computed in the step S11 by the scanning speed of the light beam 14.

In step S12, the third computing unit 180 corrects the amount of deviation (computed by the second computing unit 140) by using the correction coefficients α, β and γ stored in the RAM 58, so that a corrected amount of deviation of the main scanning direction and a corrected amount of deviation of the sub-scanning direction are computed respectively.

Specifically, during the first phase, the third computing unit 180 computes a corrected amount of deviation of the main scanning direction and a corrected amount of deviation of the sub-scanning direction, respectively, in accordance with the above-mentioned formulas: the corrected amount of deviation of the sub-scanning direction equals the amount of deviation computed by the second computing unit 140×α×β; and the corrected amount of deviation of the main scanning direction equals the amount of deviation computed by the second computing unit 140×(1−α)×β.

During the second phase, the third computing unit 180 computes a corrected amount of deviation of the main scanning direction and a corrected amount of deviation of the sub-scanning direction, respectively, in accordance with the above-mentioned formulas: the corrected amount of deviation of the sub-scanning direction equals the amount of deviation computed by the second computing unit 140×α×β×γ; and the corrected amount of deviation of the main scanning direction equals the amount of deviation computed by the second computing unit 140×(1−α)×β×γ.

In this manner, the deviation amount detecting device 100 of this embodiment computes the amount of deviation by using the deviation detection patterns repeatedly for every cycle of the predetermined time (for example, 30 minutes). During the inter-cycle period in which the computation of the amount of deviation using the deviation detection patterns is held in a waiting state, the deviation amount detecting device 100 corrects the amount of deviation (which is computed by the second computing unit 140) by using the correction coefficients α, β and γ obtained based on the result of the latest detection cycle.

Every time the deviation compensation using the deviation detection patterns 26 is performed, the measuring unit 130 measures the scanning time of laser beam 14 at that time by using the synchronous detecting sensors 23_T and 23_S, and the second computing unit 140 sets the currently measured scanning time to a new reference value.

Moreover, in step 812, the storing unit 190 stores the amount of deviation of the main scanning direction and the amount of deviation of the sub-scanning direction (both computed by the third computing unit 180) into the storage device.

In step S13, it is determined whether a predetermined period (for example, 30 minutes) has elapsed after the end of the previous detection cycle of the computation of the amount of deviation using the deviation detection patterns 26.

When the predetermined period has elapsed in the step S13, the control shifts to the step S6. A new detection cycle of the computation of the amount of deviation using the deviation detection patterns 26 is performed again in the step S6, and the correction coefficients α, β and γ are replaced by the newly computed values.

When the predetermined period has not elapsed in the step S13, the control shifts to the step S10. After the waiting state of the predetermined period in the step S10, the process of computing the amount of deviation using the synchronous detecting sensors 23_T and 23_S is performed again by the second computing unit 140.

In the deviation amount detecting device 100 of this embodiment, by the use of the correction coefficients, the individual computation of the main deviation amount and the sub-deviation amount can be performed quickly with good detection accuracy without interrupting the image formation process by the image forming device.

In the deviation amount detecting device 100 of this embodiment, the deviation amount obtained by the synchronous detection signals can be corrected appropriately by using the result of detection of the deviation detection patterns, it is not necessary to use a temperature detecting mechanism, and it is possible to perform the deviation amount detection with a relatively lower cost.

The present invention is not limited to the specifically disclosed embodiments, and variations and modifications may be made without departing from the scope of the present invention.

The present application is based on Japanese patent application No. 2008-009515, filed on Jan. 18, 2008, and Japanese patent application No. 2009-002699, filed on Jan. 8, 2009, the contents of which are incorporated herein by reference in their entirety.

What is claimed is:

1. A deviation amount detecting device which computes an amount of deviation for toner images of different colors in an electrophotographic color image forming device wherein a color image is formed on a transporting member by superimposing the toner images of different colors, the deviation amount detecting device comprising;

a first computing unit configured to compute a first deviation amount repeatedly at cycles of a predetermined time based on a result of reading of deviation detection patterns formed on the transporting member of the image forming device;

a second computing unit configured to compute a second deviation amount based on a result of measurement of a scanning time between a start and an end of one main scan of a light beam on an image support of the image forming device; and a third computing unit configured to correct, during an inter-cycle period in which the computation of the first deviation amount by the first computing unit is held in a waiting state, the second deviation amount computed by the second computing unit, based on the first deviation amount computed by the first computing unit at a latest cycle, so that a corrected amount of deviation of a main scanning direction and a corrected amount of deviation of a sub-scanning direction are computed, wherein the first computing unit is configured to compute a main deviation amount of the main scanning direction and a sub-deviation amount of the sub-scanning direction respectively based on the result of reading of the deviation detection patterns, and wherein the third computing unit is configured to compute a corrected amount of deviation of the main scanning direction and a corrected amount of deviation of the sub-scanning direction respectively by using both a ratio of the sub-deviation amount computed by the first computing unit to a sum of the main deviation amount and the sub-deviation amount both computed by the first computing unit, and a ratio of the second deviation amount computed by the second computing unit to the sum of the main deviation amount and the sub-deviation amount both computed by the first computing unit.

2. The deviation amount detecting device according to claim 1, further comprising a measuring unit configured to measure a scanning time between a time the light beam is read by a first sensor disposed to be perpendicular to the main scanning direction at a position outside an imaging region corresponding to the start of one main scan and a time the light beam is read by a second sensor disposed to have a predetermined inclination angle to the main scanning direction at a position outside the imaging region corresponding to the end of one main scan.

3. The deviation amount detecting device according to claim 2, wherein the second computing unit is configured to compute an amount of change of the scanning time after the scanning time is measured multiple times, so that the second deviation amount is computed based on the amount of change of the scanning time.

4. The deviation amount detecting device according to claim 2, wherein the predetermined inclination angle to the main scanning direction is equal to $\pi/4$.

5. The deviation amount detecting device according to claim 1, wherein the third computing unit is configured to correct the second deviation amount computed by the second computing unit, by using an amount of change of a ratio of the second deviation amount computed by the second computing unit to a sum of a main deviation amount and a sub-deviation amount both computed by the first computing unit when the ratio is computed over multiple times.

6. A deviation amount detecting method which computes an amount of deviation for toner images of different colors in an electrophotographic color image forming device wherein a color image is formed on a transporting member by superimposing the toner images of different colors, comprising the steps of:

computing a first deviation amount repeatedly at cycles of a predetermined time based on a result of reading of deviation detection patterns formed on the transporting member of the image forming device;

computing a second deviation amount based on a result of measurement of a scanning time between a start and an end of one main scan of a light beam on an image support of the image forming device; and correcting, during an inter-cycle period in which the computation of the first deviation amount is held in a waiting state, the computed second deviation amount based on the first deviation amount computed at a latest cycle, so that a corrected amount of deviation of a main scanning direction and a corrected amount of deviation of a sub-scanning direction are computed, wherein the step of computing the first deviation amount computes a main deviation amount of the main scanning direction and a sub-deviation amount of the sub-scanning direction respectively based on the result of reading of the deviation detection patterns, and wherein the step of correcting the computed second deviation amount computes a corrected amount of deviation of the main scanning direction and a corrected amount of deviation of the sub-scanning direction respectively by using both a ratio of the computed sub-deviation amount to a sum of the computed main deviation amount and the computed sub-deviation amount, and a ratio of the computed second deviation amount to the sum of the computed main deviation amount and the computed sub-deviation amount.

7. The deviation amount detecting method according to claim 6, further comprising a step of:

measuring a scanning time between a time the light beam is read by a first sensor disposed to be perpendicular to the main scanning direction at a position outside an imaging region corresponding to the start of one main scan and a time the light beam is read by a second sensor disposed to have a predetermined inclination angle to the main scanning direction at a position outside the imaging region corresponding to the end of one main scan.

8. The deviation amount detecting method according to claim 7, wherein the step of computing the second deviation amount computes an amount of change of the scanning time after the scanning time is measured multiple times, so that the second deviation amount is computed based on the amount of change of the scanning time.

9. The deviation amount detecting method according to claim 7, wherein the predetermined inclination angle to the main scanning direction is equal to $\pi/4$.

10. A computer-readable recording medium storing a deviation amount detecting program which, when executed by a computer, causes the computer to perform the deviation amount detecting method according to claim 6.

* * * * *